US009112289B1

(12) United States Patent
Lin

(10) Patent No.: US 9,112,289 B1
(45) Date of Patent: Aug. 18, 2015

(54) STACKABLE BREADBOARD

(71) Applicant: Jui-Hsiang Lin, New Taipei (TW)

(72) Inventor: Jui-Hsiang Lin, New Taipei (TW)

( * ) Notice: Subject to any disclaimer, the term of this patent is extended or adjusted under 35 U.S.C. 154(b) by 0 days.

(21) Appl. No.: 14/198,606

(22) Filed: Mar. 6, 2014

(51) Int. Cl.
*H01R 29/00* (2006.01)
*H01R 9/28* (2006.01)

(52) U.S. Cl.
CPC ..... *H01R 9/28* (2013.01)

(58) Field of Classification Search
CPC ..... H01R 29/00; H01R 13/42
USPC ..... 439/49, 744, 598, 599, 589, 595, 871
See application file for complete search history.

(56) References Cited

U.S. PATENT DOCUMENTS 3,475,720 A * 10/1969 Culver ..... 439/744
4,914,062 A * 4/1990 Voltz ..... 439/607.11

* cited by examiner

*Primary Examiner* — Phuongchi T Nguyen
(74) *Attorney, Agent, or Firm* — Leong C. Lei

(57) ABSTRACT

A stackable breadboard includes a plurality of through holes formed therein, including a plurality of first insertion holes that extends through a top surface a bottom surface thereof and a plurality of second insertion holes that extend through the top surface and side surfaces thereof. The first insertion holes extends longitudinally to allow more than one breadboard to connect in a longitudinally stacked arrangement through male and female connection terminals thereby achieving a three-dimensional stacked arrangement that effectively reduce the surface area occupied thereby. Further, the second insertion holes are arranged to extend, at opposite ends thereof, in the longitudinal and transverse directions to allow more than one breadboard to connect to each other sideways by means of the male and female connection terminals to achieve expansion of the functionality thereof.

6 Claims, 5 Drawing Sheets

STACKABLE BREADBOARD

TECHNICAL FIELD OF THE INVENTION

The present invention generally relates to a stackable breadboard, and more particularly to a breadboard in which a plurality of through holes is formed, including a plurality of first insertion holes that extends through a top surface a bottom surface thereof and a plurality of second insertion holes that extend through the top surface and side surfaces thereof, wherein the first insertion holes extends longitudinally (up-down direction) to allow more than one breadboard to connect in a longitudinally stacked arrangement through male and female connection terminals thereby achieving a three-dimensional stacked arrangement that effectively reduce the surface area occupied thereby. Further, the second insertion holes are arranged to extend, at opposite ends thereof, in the longitudinal and transverse directions to allow more than one breadboard to connect to each other sideways by means of the male and female connection terminals to achieve expansion of the functionality thereof.

DESCRIPTION OF THE PRIOR ART

Science and technology are now under extremely fast progress, bringing electronic products, such as tablet computers, smart phones, notebook computers, and various 3C products, into the living of the modern people as necessaries of life. With such electronic products, people can make immediate communication with relatives, friends, and clients for transmission of important messages and information, or connection with the Internet can be established with such electronic products to open a gate to the worldwide span of knowledge in the networks.

The electronic products are each under progressive development to involve new functions. Electronic research engineers have been working around the clock to improve and test these electronic products to develop electronic products with remarkable and high innovation and creativity. Before making a prototype circuit of an electronic product under development, most of the electronic research engineers often use a test board to construct the circuit. Such a test board is generally referred to as a "solderless breadboard" or simply a "breadboard".

Referring to FIG. 1, a conventional breadboard A2 is generally constructed to include multiple single-opening insertion holes A21. All the insertion holes A21 have openings facing upward. In addition, the breadboard A2 also comprises multiple conductive contacts A11 mounted therein. The conductive contacts A11 extend upward to each form an insertion section A1. The insertion sections A1 are arranged to respectively correspond to the insertion holes A21. A closure plate is arranged on the undersurface of the breadboard A2 for closing. This arrangement allows an electronic research engineer to plug various electronic components into the insertion holes A21 of the breadboard A2 so that the electronic research engineer, with the easy insertion of the electronic components into the breadboard A2, can easily conduct operations for corrections, modifications, and tests for simulation and completion of a desired electronic control circuit.

However, the conventional breadboard A2 is constructed so that the openings of the insertion holes A21 all face upward. This makes it only possible for the electronic components to be inserted to the top (the upper surface) of the breadboard A2 and the insertion is generally constrained to the surface area of the breadboard A2. For making a large-sized simulation circuit, it often needs to use a number of breadboards A2 to enable all the desired electronic components to be inserted thereto. This poses a problem that once more than one breadboard A2 is used for connection with each other, the arrangement of these breadboards A2 can only be made in a planar form or can only be connected by being arranged on a planar surface. This inevitably increases the area of the planar surface occupied by the breadboards and often leads to a difficult to mount the breadboards A2 used for the simulation to a preset electronic carrier for test of operation of hardware or accessories.

SUMMARY OF THE INVENTION

The primary object of the present invention is to provide a stackable breadboard, which comprises at least one breadboard and a plurality of male connection terminals and a plurality of female connection terminals.

The breadboard comprises a plurality of first insertion holes and a plurality of second insertion holes. The first insertion holes extend through the top surface and the bottom surface of the breadboard and the second insertion holes extend through the top surface and the side surfaces of the breadboard. The first insertion holes and the second insertion holes each receive a conductive member therein. The male connection terminals and the female connection terminals are connectable, in a rotatable manner, to each other and are insertable into the first insertion holes and the second insertion holes.

As such, the arrangement of the first insertion holes to extend longitudinally (up-down direction) and being provided with electrical interconnection between opposite ends thereof allows an electrical component to be inserted into either the top surface or the bottom surface of the breadboard to provide an expansion of the area of the breadboard into which the insertion can be made. Further, the male connection terminals or the female connection terminals can be inserted into the top surface or the bottom surface of the breadboard to allow more than one the breadboard to be connected in a longitudinal stacked arrangement through the female connection terminals to effectively reduce the area occupied thereby. Further, with the second insertion holes being arranged to have opposite ends thereof extend longitudinally and transversely and being provided with electrical interconnection therebetween, more than one breadboard can be connected stably and sideways by means of the male and female connection terminals so as to eliminate the needs of complicated and unstable connection through jump lines adopted between two conventional breadboards.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
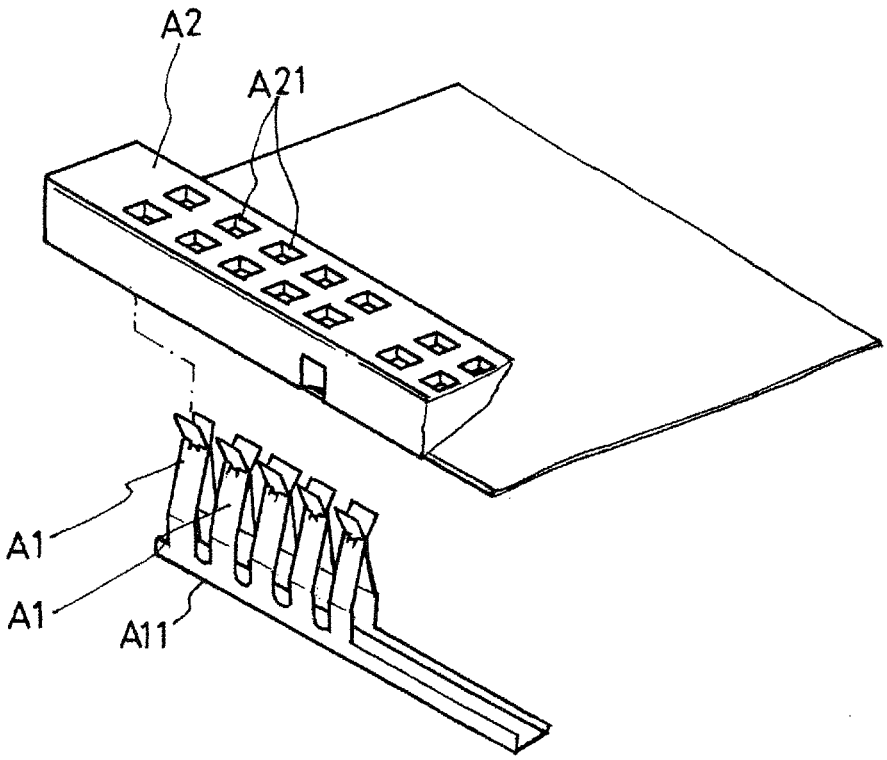
PRIOR ART FIG.1
FIG. 1 is a perspective view showing a conventional breadboard.
Figure 2:
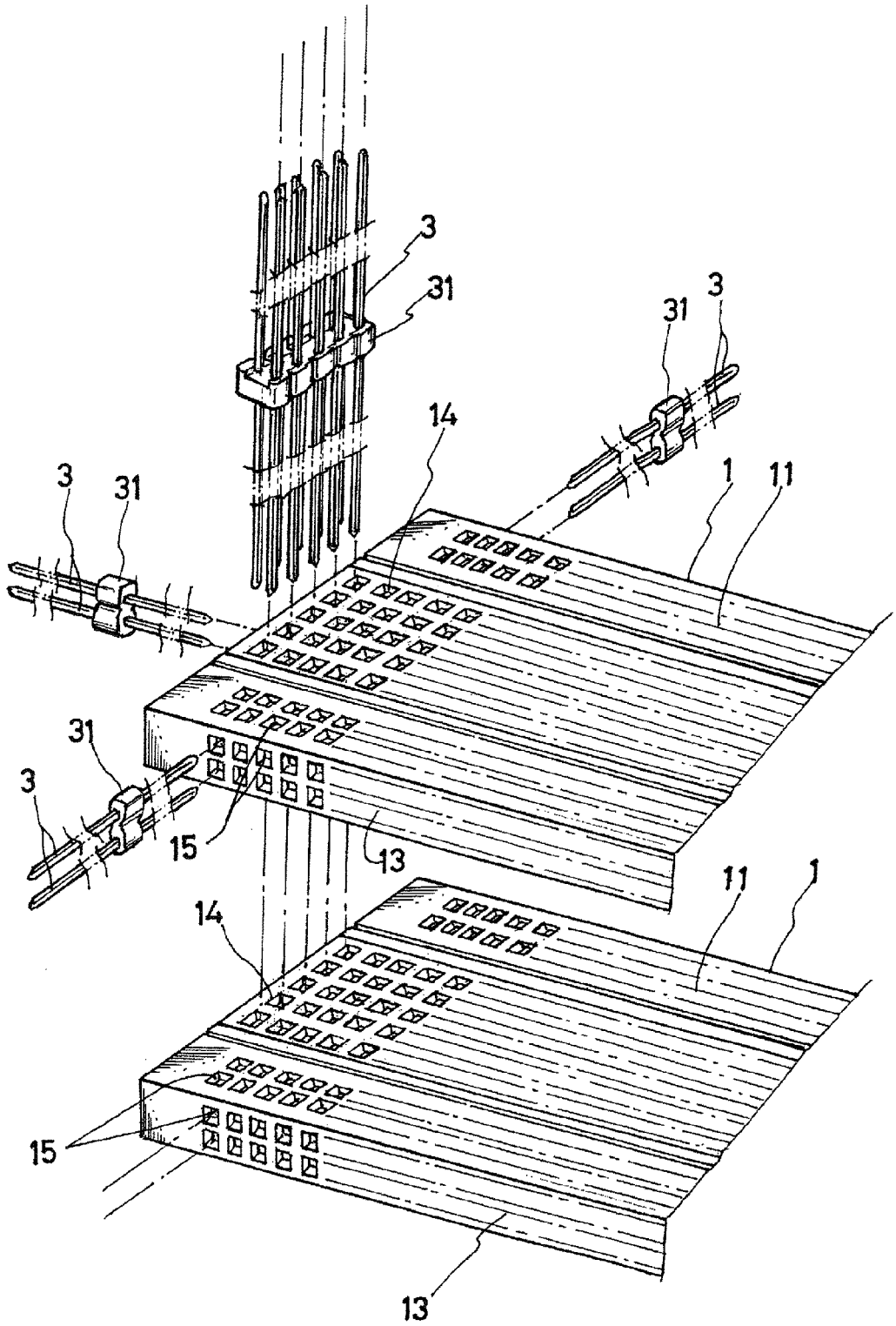
FIG. 2 is a perspective view showing a stackable breadboard according to an embodiment of the present invention to be assembled with another stackable breadboard.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 2-7, the present invention discloses a stackable breadboard, which comprises at least one breadboard 1, a plurality of conductive members 2, a plurality of male connection terminals 3, and a plurality of female connection terminals 4.

The breadboard 1 comprises a top surface 11, a bottom surface 12, and a plurality of side surfaces 13. The breadboard 1 comprises a plurality of first insertion holes 14 and each of the first insertion holes 14 is arranged to extend through the top surface 11 and the bottom surface 12 of the breadboard 1. The breadboard 1 also comprises a plurality of second insertion holes 15. The second insertion holes 15 are arranged in circumferential areas of the first insertion holes 14 and adjacent to the side surfaces 13 of the breadboard 1. The second insertion holes 15 are arranged to respectively extend through the top surface 11 and the side surfaces 13 of the breadboard 1.

The plurality of first insertion holes 14 can be arranged in the form of an array. And, the second insertion holes 15 are arranged on the outermost circumferential areas of the first insertion holes 14 and adjacent to the side surfaces 13 of the breadboard 1.

Figure 7:
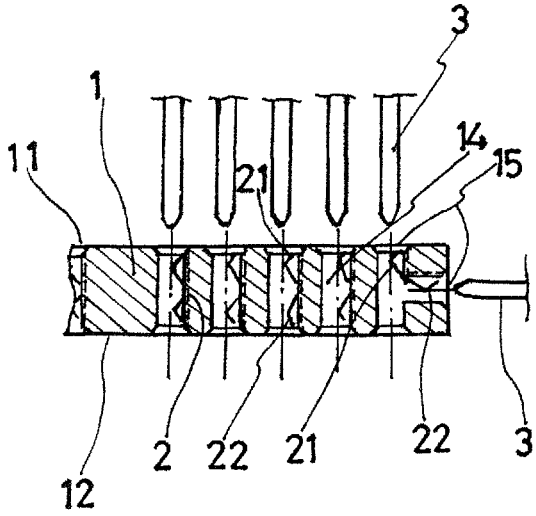
FIG. 7 is a cross-sectional view of the stackable breadboard of the present invention.

The conductive members 2 each comprise at least one first conductive section 21 and at least one second conductive section 22. The conductive members 2 are respectively arranged in the first insertion holes 14 and the second insertion holes 15. The conductive members 2 are received, in a longitudinally arranged manner, in the first insertion holes 14 so that the first conductive section 21 and the second conductive section 22 of a conductive member 2 are located at opposite openings of the respective first insertion hole 14 to provide the top and bottom openings of the first insertion hole 14 with electrical interconnection therebetween. The conductive members 2 are also received in the second insertion holes 15 by being bent to show an L-shape so that the first conductive section 21 and the second conductive section 22 of a conductive member 2 are respectively located at two end openings of the respective second insertion hole 15 (as shown in FIG. 7) to provide the top opening and the side opening of the second insertion hole 15 with electrical interconnection therebetween.

The male connection terminals 3 each comprise at least one stop block 31. The female connection terminals 4 each comprise at least one insertion receptacle 41 and the insertion receptacle 41 is provided with at least one through hole 411. The male connection terminal 3 is insertable into the through hole 411 of the insertion receptacle 41 of the female connection terminal 4 to establish electrical connection and rotatable coupling between the male connection terminals 3 and the female connection terminals 4 for expansion of the stackable breadboard.

With the first insertion holes 14 longitudinally (up-down direction) extending through the top surface 11 and the bottom surface 12 of the breadboard 1 and being provided with electrical interconnection between top and bottom open ends thereof, an electronic component is insertable into either the top surface 11 or the bottom surface 12 of the breadboard 1 so as to expand the service surface area of the breadboard 1 that receives the insertion or use of the electronic component.

Figure 3:
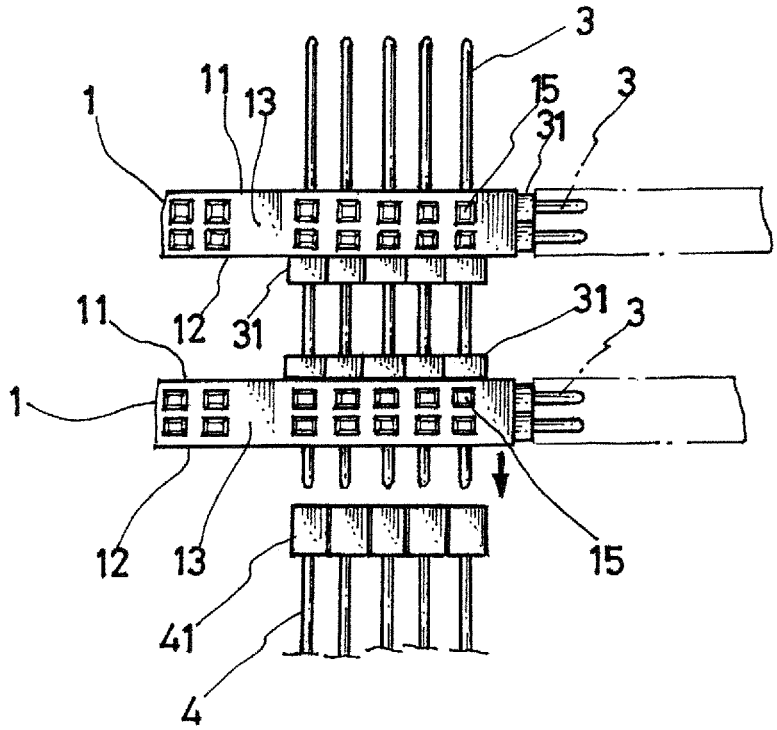
FIG. 3 is a side elevational view showing multiple stackable breadboards of the present invention assembled together.
Figure 4:
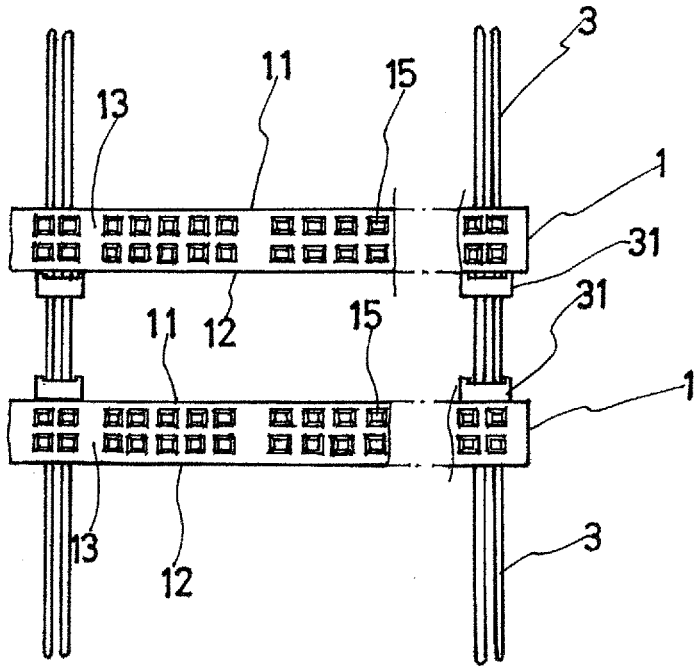
FIG. 4 is a front view showing multiple stackable breadboards of the present invention assembled together.
Figure 5:
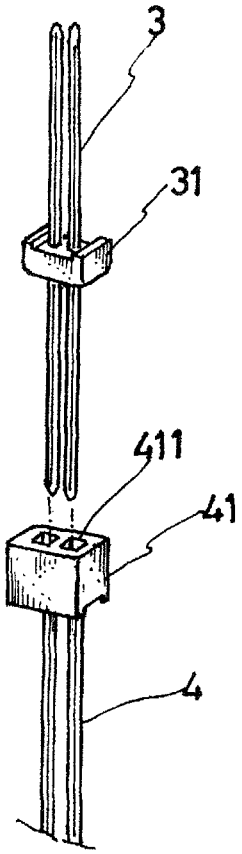
FIG. 5 is a perspective view showing a male connection terminal and a female connection terminal of the stackable breadboard of the present invention to be connected to each other.
Figure 6:
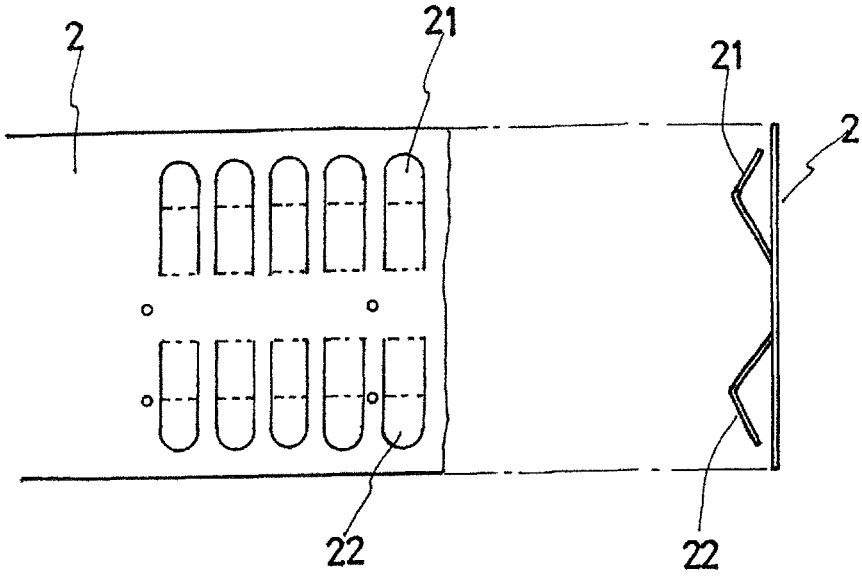
FIG. 6 is a schematic view showing a conductive member of the stackable breadboard of the present invention.

Further, with the first insertion holes 14 longitudinally (up-down direction) extending through the top surface 11 and the bottom surface 12 of the breadboard 1 and being provided with electrical interconnection between top and bottom open ends thereof, the male connection terminal 3 can be used to have one end thereof inserted into one of the first insertion holes 14 of the bottom surface 12 of one breadboard 1, while an opposite end of the male connection terminal 3 is insertable into one of the first insertion holes 14 of the top surface 11 of another breadboard 1, so that more than one breadboard 1 can be connected in a longitudinally stacked manner by means of the male connection terminal 3; or alternatively, the opposite ends of the male connection terminal 3 are each inserted into one breadboard 1 in such a way that the ends of the male connection terminal 3 extend through and project beyond the breadboards 1 to electrically connect to female connection terminals 4. The female connection terminals 4 may then be respectively inserted to other breadboards 1 to allow more than one breadboard 1 to be connected in a longitudinally stacked manner by means of the male connection terminal 3 and the female connection terminals 4 (as shown in FIGS. 3 and 4). Further, spacing distance between one breadboard 1 and another breadboard 1 can be determined through height adjustment and positioning of the stop block 31 on the male connection terminal 3 so as to provide a desired structure for longitudinal stacking and connection.

With the second insertion holes 15 extending, with opposite ends thereof, through the top surface 11 and the side surface 13 of the breadboard 1 in the longitudinal and transverse directions and being provided with electrical interconnections between the open ends thereof, the male connection terminal 3 can be used to have one end thereof inserted into one of the second insertion holes 15 of one of the side surfaces 13 of a breadboard 1, while an opposite end of the male connection terminal 3 is insertable into one of the second insertion holes 15 of one of the side surfaces 13 of another breadboard 1, so that more than one breadboard 1 can be connected in a sideway (transversely) connected manner by means of the male connection terminals 3. This is completely different from the conventional way of connection that is achieved through jump lines that is generally an unstable and complicated way of connection.

In summary, the present invention arranges first insertion holes 14 to longitudinally (up-down direction) extend through the top surface 11 and the bottom surface 12 of the breadboard 1 and being provided electrical interconnection between opposite end openings thereof so that when more than one breadboard 1 is involved, longitudinal stacking and connection can be achieved through the male connection terminals 3 and the female connection terminals 4 so as to construct a three-dimensional stacked arrangement of the breadboard 1, which helps reduce the area occupied thereby. Further, second insertion holes 15 are arranged to having opposite ends thereof respectively extending longitudinally and transversely through the top surface 11 and the side surface 13 of the breadboard 1 and being provided electrical interconnection therebetween, so that when more than one breadboard 1 is involved in a use, horizontal or sideways connection can be achieved through the male connection terminals 3 for further expansion to couple to or establish a stacked arrangement of the breadboard 1.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A stackable breadboard, comprising:

at least one breadboard, which comprises a top surface, a bottom surface, and a plurality of side surfaces, the breadboard comprising a plurality of first insertion holes, the first insertion holes being arranged to each extend through the top surface and the bottom surface;

a plurality of conductive members, which is respectively set in the first insertion holes; and a plurality of male connection terminals, which is partly insertable into the first insertion holes to be electrically engageable with the conductive members, each of the male connection terminals comprising at least one stop block mounted thereto and engageable with one of the top surface and the bottom surface of the breadboard to constrain insertion of a portion of the male connection terminal into the first insertion holes.

2. The stackable breadboard according to claim 1, wherein the conductive members each comprise at least one first conductive section and at least one second conductive section, the conductive members being set longitudinally in the first insertion holes in such a way that the first conductive section and the second conductive section of each of the conductive members are respectively located at openings of opposite ends of the respective first insertion hole.

3. The stackable breadboard according to claim 1 further comprising a plurality of female connection terminals, the female connection terminals each comprising at least one insertion receptacle, the insertion receptacle comprising at least one through hole formed therein, the male connection terminals being insertable into the through hole of the female connection terminals to allow the male connection terminals and the female connection terminals to electrically connect to and rotatably couple with each other.

4. A stackable breadboard, comprising:

at least one breadboard, which comprises a top surface, a bottom surface, and a plurality of side surfaces, the breadboard comprising a plurality of second insertion holes, the second insertion holes being arranged adjacent to the side surfaces, the second insertion holes having opposite ends respectively extending through the top surface and the side surfaces;

a plurality of conductive members, which is respectively set in the second insertion holes; and a plurality of male connection terminals, which is partly insertable into the second insertion holes to be electrically engageable with the conductive members each of the male connection terminals comprising at least one stop block mounted thereto and engageable with one of the top surface and the side surface of the breadboard to constrain insertion of a portion of the male connection terminal into the second insertion holes.

5. The stackable breadboard according to claim 4, wherein the conductive members each comprise at least one first conductive section and at least one second conductive section, the conductive members being respectively set in the second insertion holes by being bent to show an L-shape, the first conductive section and the second conductive section of each of the conductive members being respectively located at openings of the opposite ends of the second insertion holes.

6. The stackable breadboard according to claim 4 further comprising a plurality of female connection terminals, the female connection terminals each comprising at least one insertion receptacle, the insertion receptacle comprising at least one through hole formed therein, the male connection terminals being insertable into the through hole of the female connection terminals to allow the male connection terminals and the female connection terminals to electrically connect to and rotatably couple with each other.

* * * * *